United States Patent [19]

Beisel

[11] Patent Number: 4,933,072

[45] Date of Patent: Jun. 12, 1990

[54] MATERIAL CLASSIFIER

[76] Inventor: Victor A. Beisel, Rte. 1, Box 26, Fargo, Okla. 73840

[21] Appl. No.: 682,743

[22] Filed: Dec. 17, 1984

[51] Int. Cl.[5] ..... B07B 4/00

[52] U.S. Cl. ..... 209/142; 209/135; 209/149; 209/154; 239/DIG. 7; 406/194

[58] Field of Search ..... 209/638, 639, 906, 932, 209/134, 133, 135, 137, 149, 154, 142, 143; 406/93-95, 144, 194; 239/DIG. 7

[56] References Cited

U.S. PATENT DOCUMENTS

| | | | |
|---|---|---|---|
| 2,643,769 | 6/1953 | Tanner | 209/137 |
| 2,702,986 | 3/1955 | Kadosch et al. | 239/DIG. 7 |
| 3,638,400 | 2/1972 | Heilmann | 209/134 |
| 4,486,300 | 12/1984 | Prieb | 209/638 |

FOREIGN PATENT DOCUMENTS

| | | | |
|---|---|---|---|
| 563489 | 9/1958 | Canada | 406/93 |
| 563929 | 12/1923 | France | 209/135 |
| 865430 | 9/1981 | U.S.S.R. | 209/135 |
| 956056 | 9/1982 | U.S.S.R. | 209/135 |
| 1601801 | 11/1981 | United Kingdom | 406/93 |

*Primary Examiner*—Donald T. Hajec

*Attorney, Agent, or Firm*—Fleit, Jacobson, Cohen, Price, Holman & Stern

[57] ABSTRACT

An elongated, horizontal and at least partially closed air jet dispersion and air jet entrained material deceleration zone is provided and one end of the zone includes at least skewed velocity distribution nozzle of the circular Coanda surface-type opening inwardly along the zone toward the other end thereof. The zone includes discharge structure defining a plurality of downwardly opening gravity-type outlets spaced longitudinally along the zone and duct structure for flowing air and airflow entrained solids therethrough at high velocity is provided. The duct structure includes an outlet end opening into the nozzle and an inlet end open to the ambient atmosphere and positioned to receive gravity discharged solid materials from the outlet spaced one outlet from the aforementioned one end of the zone. A first form of the invention utilizes a central high velocity air jet directed into the inlet end of the duct for causing airflow through the duct and a second form of the invention utilizes a high velocity annular jet of air introduced into the duct intermediate its opposite ends with that annular jet axially centered relative to the corresponding portion of the duct and flush with the inner surface of the duct. Further, structure is provided whereby the radial extent of the annular jet may be adjusted.

13 Claims, 2 Drawing Sheets

10
12
14
16
18
20
21
22
24
26
28
30
32
34
36
38
40
42
44
46
48
50
52
54
56
58
60
62
2
2

MATERIAL CLASSIFIER

BACKGROUND OF THE INVENTION

1. Field of the Invention

This invention relates to the classifying or separation and sorting of solids, primarily by weight, through the utilization of a skewed Coanda jet effect and incorporates a duct structure for confining an airflow column having solid material entrained therein with the airflow column discharging into a Coanda jet effect apparatus to enable solid materials of different weights to be separated as a result of different trajectory paths through space.

2. Description of Related Art

Various different forms of material classifiers including some of the general structural and operational features of the instant invention are disclosed in U.S. Pat. Nos. 393,411, 2,274,887, 2,381,954, 3,348,676, 3,878,995, 3,888,352 and 3,924,901.

SUMMARY OF THE INVENTION

The classifier of the instant invention has been specifically designed to provide a means whereby seeds, such as grass seeds, may be separated from trash and seed hulls. The invention utilizes a skewed Coanda jet effect to propel the seeds and trash generally horizontally through space with only the lighter loose hull parts and trash following a low trajectory, a mixture of trash and clean seed following the next higher trajectory and only cleaned seeds following the highest trajectory.

In addition, the instant invention includes compressed air power units for effecting high velocity airflow through ducts and supplying air to Coanda-type outlets and the power units include a first unit for introducing air into a mid-length portion of a duct about the periphery thereof and a second unit for discharging compressed air generally centrally into the inlet end of a duct with which a lateral solid material inlet is operatively associated.

The main object of this invention is to provide an apparatus by which seeds may be cleaned of trash and classified.

Another object of this invention is to provide a classifier which will be capable of cleaning and classifying various different types of seeds.

Still another important object of this invention is to provide a classifier capable of being adjusted according to the moisture content, size and weight of given seeds to be classified thereby.

A final object of this invention to be specifically enumerated herein is to provide a classifier in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figures 1, 2, 3:
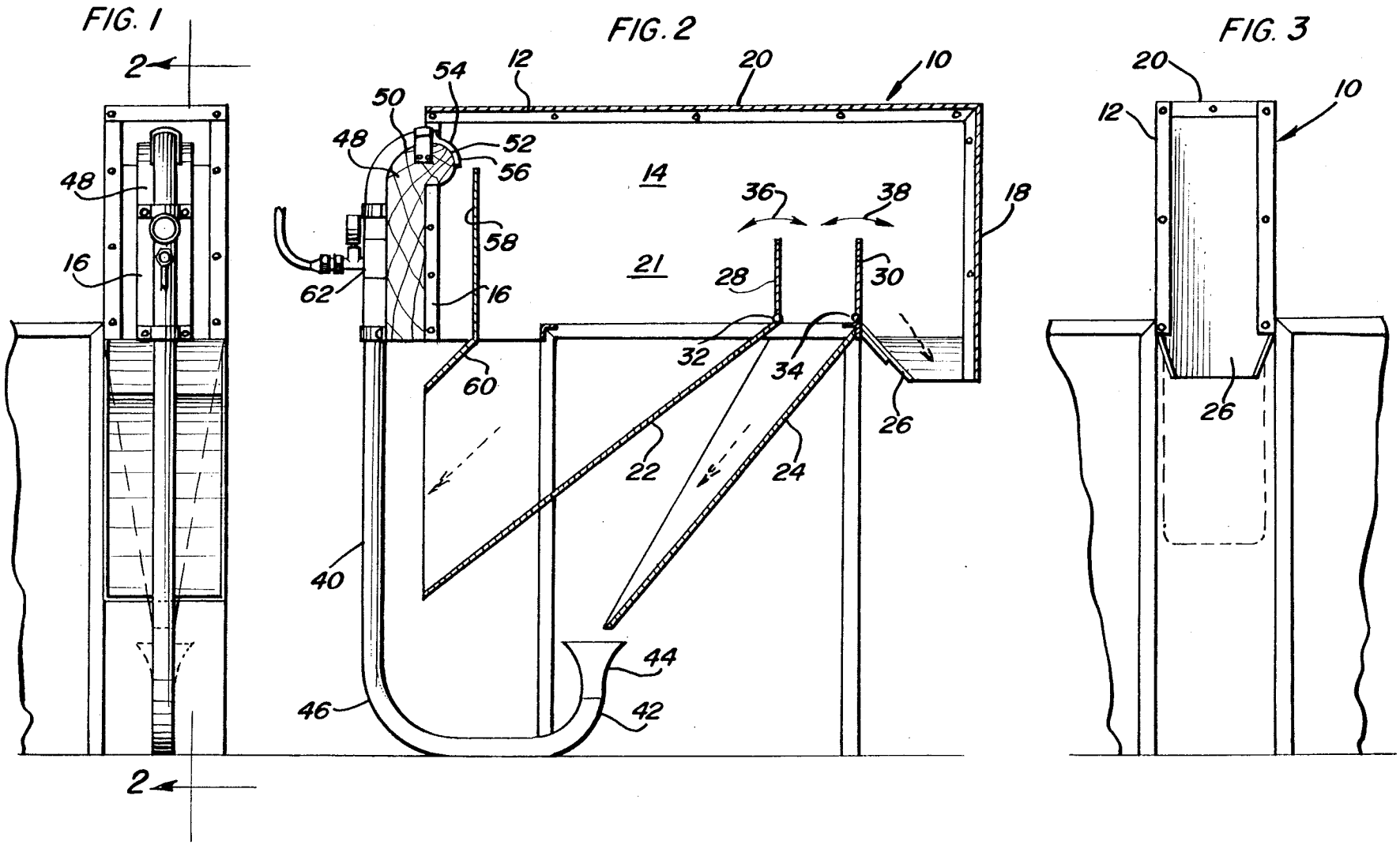
FIG. 1 is a front elevational view of a first form of classifier constructed in accordance with the present invention.
FIG. 2 is a vertical sectional view taken substantially upon the plane indicated by the section line 2—2 of FIG. 1.
FIG. 3 is a rear elevational view of the assemblage illustrated in FIGS. 1 and 2.

Referring now more specifically to the drawings, the numeral 10 generally designates a first form of classifier constructed in accordance with the present invention. The classifier 10 includes an elongated housing 12 having opposite sidewalls 14, a partial front wall 16 and a rear wall 18. The upper portion of the housing 12 is closed by a top wall 20, although the top wall 20 may not be needed in some installations, and the interior of the housing 12 defines an elongated air jet dispersion and air jet entrained material deceleration zone 21 extending between the sidewalls 14.

First, second and third hopper-type gravity discharge chutes 22, 24 and 26 extend downwardly from an partially close the lower portion of the zone 21. The chutes 22, 24 and 26 are spaced longitudinally of the housing 12 from the front end thereof. The chute 22 comprises a trash chute, the chute 24 comprises a chute for receiving a mixture of trash, partially cleaned seeds and fully cleaned seeds and the chute 26 is designed to receive only cleaned seeds and includes a lower end shaped to facilitate bagging of seeds discharged from chute 26.

The rear extremities of the upPer end portions of the chutes 22 and 24 include upstanding partitions 28 and 30 extending transversely between the sidewalls 14 and upwardly into the zone 20. The partitions 28 and 30 are pivotally mounted as at 32 and 34 and may be swung back and forth in the directions of the arrows 36 and 38 and releasably retained in adjusted position in any convenient manner (not shown) for changing the length of the "break" or "cut point" between chutes 22 and 26 and/or shifting the "break" or "cut point". Further, the chute 24 may be completely closed.

A single air duct 40 is provided and includes an upwardly directed inlet end portion 42 provided with an outwardly flaring funnel 44 spaced beneath the lower end of the chute 24 and in registry therewith for receiving solid materials falling downwardly along the chute 24. In addition, it will be noted that the funnel 44 is open to the ambient atmosphere and also that sufficient space is defined between the open upper end of the funnel and the lower end of the chute whereby additional seeds to be classified may be gravity discharged into the funnel.

The duct 40 extends from the funnel 44 forwardly and then turns upwardly as at 46 along the front of the housing 12. The front wall 16 of the housing 12 includes a formed central piece 48 upwardly along which the duct 40 extends and the formed piece 48 includes an inwardly curving upper end surface 50 of progressingly decreasing radius and which projects into and curves downwardly within the forward end of the zone 20 as at 52. The upper end portion of the duct 40 is flexible and secured to the surface 50 so as to extend therealong and conform thereto. The upper portion of the duct 40, at the outlet end thereof, is cut away as at 54 defining a longitudinally curved trough 56 which is longitudinally curved and concave in transverse cross section. The trough 56 extends over the inwardly and downwardly curving portion 52 of the surface 50 disposed within the zone 20. In addition, a baffle 58 is generally disposed in the forward portion of the zone 20 below and slightly rearward of the terminal end of the trough 56 and the lower end of the portion of the baffle 58 is forwardly angulated as at 60 and defines the upper extremity of the chute 22.

Figure 4:
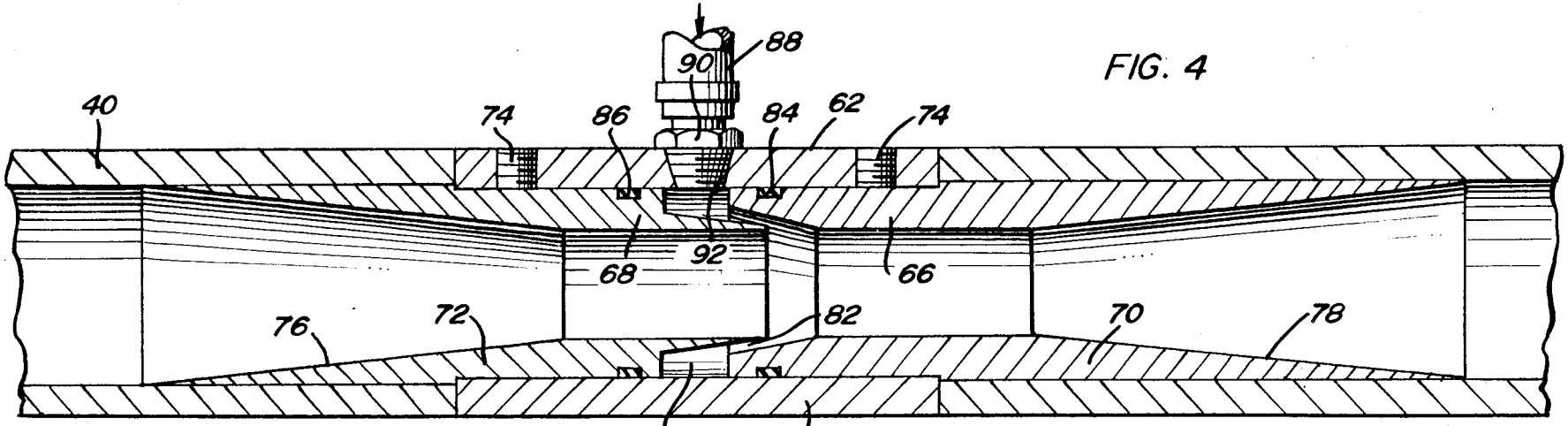
FIG. 4 is an enlarge longitudinal sectional view of the power unit of the classifier illustrated in FIGS. 1-3.

A power unit 62 is disposed within the conduit 40. As may best be seen from FIG. 4 of the drawings, the power unit 62 includes a center sleeve portion 64 into whose opposite ends slightly diametrically reduced opposing ends 66 and 68 of a pair of venturi sleeves 70 and 72 are telescoped and secured in adjusted position through the utilization of set screws 74 threadedly engaged in the central sleeve portion 64 and abutted against the ends 66 and 68.

The sleeve 72 comprises an inlet sleeve for the power unit 62 and the sleeve 70 comprises an outlet sleeve for the power unit 62. The inlet end of the sleeve 72 includes a gradually inwardly tapering interior 76 while the outlet end of the sleeve 70 includes an interior 78 which gradually increases in diameter toward the outlet end thereof., The interiors of the adjacent ends of the sleeves 70 and 72 are substantially the same diameter and the adjacent ends of the sleeves 70 and 72 are slightly loosely telescopically engaged and define an annular compressed air inlet passage 80 within the central sleeve portion 64 and which opens into the interior of the power unit 62 through an annular zone 82 whose radial extent may be adjusted by axially relatively shifting the sleeves 70 and 72 within the central sleeve portion 64. The sleeves 70 and 72 include peripheral O-rings 84 and 86 for forming a fluid tight seal with the interior of the central sleeve portion 64 on opposite sides of the annular compressed air inlet passage 80 and a compressed air line 88 opens into the passage 80 through a radial fitting 90 removably threadingly engaged in a threaded radial bore 92 formed in the central portion of the sleeve 64.

Upon the introduction of compressed air into the passage 80 an annular discharge of air into the interior of the duct 40 will be effected in a downstream direction through the zone 82 and ambient air will be drawn into the funnel 44. Thus, any materials falling from the chute 24 and into the funnel 44 as well as other materials gravity discharged into the funnel 44 will be carried through the duct 40 toward outlet end thereof defined by the trough 56.

The trough 56 defines a discharge nozzle of the partial circular Coanda surface-type and the solid materials introduced into the funnel 44 will be discharged from the nozzle in a generally horizontal direction toward the rear end wall 18 of the housing 12. However, the lighter particles such as seed hull particles and trash will quickly decelerate as the discharge jet of air experiences dispersion while moving rearwardly through the housing 12 and the seed hull particles and trash will fall downwardly from the housing 12 through the chute 22. Thereafter, some seeds which have been cleaned of trash as well as some seeds only partially cleaned of trash will fall into the chute 24 between the baffles 28 and 30. Thereafter, the cleaned seeds will fall into the chute 26. Inasmuch as the partially cleaned seeds fall from the housing 12 through the chute 24, they will again be passed through the system for complete cleaning and additional seeds to be classified by the classifier 10 may be introduced into the funnel 44 together with the partially cleaned seeds which fall thereinto from the chute 24.

The baffles 28 and 30 may be angularly shifted as desired to effect the most desirable classification of seeds. Further, the velocity of air admitted into the duct 40 from the annular compressed air inlet passage 80 may be adjusted. Also, a majority of the air discharged at 54 continues to curve along the trough and is caught on the front side of baffle 58. Therefore, only a small amount of the discharged air and trash is discharged through the large cross sectional area chute 22 with the result that very little air born dust is discharged from the classifier 10.

Figure 7:
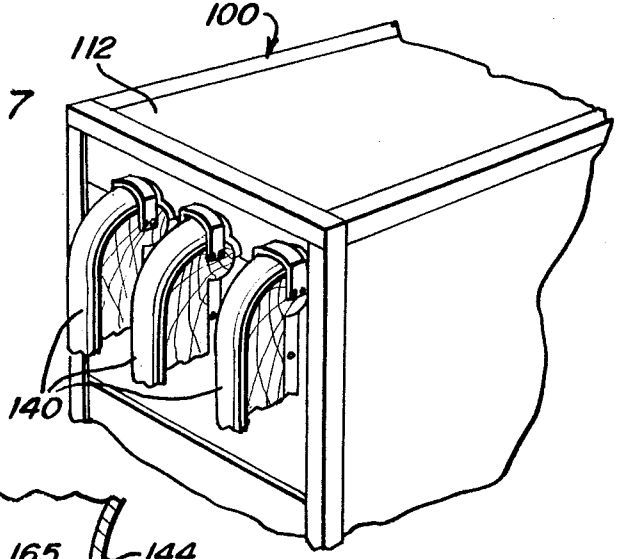
FIG. 7 is a fragmentary enlarged perspective view of the front end portion of the modified form of classifier illustrated in FIG. 5.
Figure 6:
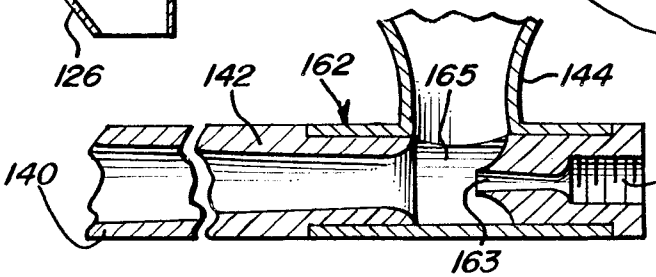
FIG. 6 is an enlarged vertical sectional view of the power unit portion of the classifier illustrated in FIG. 5.
Figure 5:
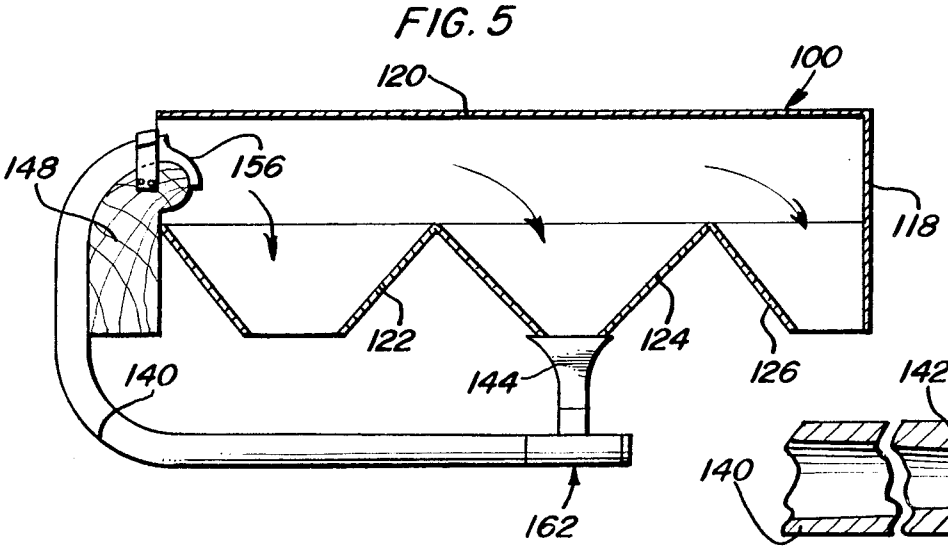
FIG. 5 is a longitudinal vertical sectional view of a second form of classifier.

With attention now invited more specifically to FIGS. 5–7, there may be seen a modified form of classifier referred to in general by the reference numeral 100. The classifier 100 is similar in many respects to the classifier 10 and the various components of the classifier 100 which find their equivalents in classifier 10 are designated by numerals in the 100 series corresponding to the numerals given the various similar components of the classifier 10.

The classifier 100 differs from the classifier 10 in that the power unit 162 of the classifier 100 is constructed as an integral part of the funnel 144 corresponding to the funnel 44. The power unit 162 is mounted on the inlet end portion 142 of the duct 140 and includes a discharge nozzle 163 for discharging a jet of compressed air centrally axially into the inlet end of the duct 140. The funnel 144, into which seeds to be classified may be gravity discharged, opens vertically downwardly into a closed area 165 immediately outward of the inlet end of the duct 140 and into which air is discharged from the nozzle 163. Of course, the nozzle 163 includes a threaded inlet end 167 in which a fitting corresponding to the fitting 90 may be removably threadedly engaged. The power unit 162 functions somewhat differently from the power unit 62, although both units serve to effect a high velocity flow of air through the corresponding duct by the admission of high velocity air into the corresponding duct in a downstream direction. Inasmuch as the jet of air discharged from the nozzle 163 is moving in a direction at generally right angles to the direction in which seeds being induced into the duct 140 fall from the funnel 144, the jet discharge of air from the nozzle 163 has a tendency to rapidly accelerate and act directly upon the seeds and to thus dehull the seeds while they are being strongly agitated and experiencing quite rapid acceleration. The power unit 62, on the other hand, acts upon the seeds after they have already been accelerated and are entrained within an airflow moving through the duct 40 and the annular laminar discharge of air through the annular zone or slot 82 accelerates the seeds more gradually and more gently.

With specific reference now to FIG. 7, it may be seen that the classifier 100 utilizes a plurality of ducts 140 which open into the housing 112 through the front end thereof. Of course, when three ducts 140 are used the chute 24 may include either a single outlet or three separate outlets and three funnels 144 and power units 162 are operatively associated with the inlet ends of the three ducts 140. Actually, the housings 12 and 112 do not need the top walls 20 and 120 thereof. Further, the rear end walls 18 and 118 of the housings 12 and 112 are not needed but are provided in order to prevent ambient air current from adversely affecting proper operation of the classifiers 10 and 100. Also, the classifiers 10 and 110 could be lengthened somewhat and provided with additional chutes between chutes 24 and 26 and between chutes 124 and 126. In this manner different types of seeds could be classified at the same time.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A seed classifier including laterally spaced apart and registered upstanding wall means defining an elongated air jet dispersion and air jet entrained material deceleration zone extending generally horizontally along and between said wall means, discharge means defining a plurality of downwardly opening gravity-type outlets spaced longitudinally along said zone, at least one skewed Coanda nozzle opening inwardly of one end of said zone in a generally horizontal direction and at a level spaced above said discharge means, said nozzle being generally of the circular Coanda surface-type, duct means including inlet and outlet ends, said duct means outlet end forming said nozzle, said duct means being adapted to flow air and airflow entrained seeds therethrough at high velocity, said nozzle including a partial circular Coanda-surface serving curving downwardly from said direction.

2. The classifier of claim 1 including compressed air inlet means opening into said duct means upstream from said nozzle for effecting a high velocity flow of air in said duct means toward said nozzle.

3. The classifier of claim 2 wherein said air inlet means is disposed closely adjacent the inlet end of said duct means.

4. The classifier of claim 1 wherein said air inlet means is disposed closely upstream from said nozzle and remote from said inlet end of said duct means.

5. The classifier of claim 4 wherein said inlet end of said duct means is disposed to receive gravity discharged materials from one of said outlets spaced at least one outlet from said one end of said zone.

6. The classifier of claim 5 wherein said duct means inlet end is in open communication with said one outlet to also receive ambient air therein.

7. The classifier of claim 5 wherein said air inlet means includes means for introducing an annular jet of air into a diametrically reduced portion of the interior of said duct means with said annular jet of air being substantially centered relative to the interior of said diametrically reduced portion of said duct means.

8. The classifier of claim 3 wherein said air inlet means includes structure for discharging a concentrated jet of air axially into the inlet end of said duct means.

9. The classifier of claim 8 wherein said inlet end of said duct means is disposed to receive gravity discharge materials from one of said outlets spaced at least one outlet from said one end of said zone.

10. The classifier of claim 9 wherein said inlet end includes a right angled inlet structure for receiving the gravity discharge of materials from said one of said outlets.

11. The classifier of claim 1 wherein said classifier includes first and second upstanding transverse baffles spaced along said zone, said outlets including first, second and third outlets spaced along said zone from said one end thereof, said first baffle being disposed between said first and second outlets and said second baffle being disposed between said second and third outlets, said baffles being mounted in said zone for adjusted angular displacement toward and away from each other and longitudinally of said zone about axes closely paralleling the lower marginal portions of said baffles and extending transversely of said zone.

12. The classifier of claim 10 wherein said classifier includes a plurality of said nozzles spaced transversely of said one end of said zone and an equal number of duct means connected to said nozzles.

13. A material classifier including a horizontally discharging skewed Coanda nozzle facing in a first horizontal direction, upwardly facing classified material receiving means extending generally horizontally in said direction from an elevation spaced below the elevation of said nozzle, duct means including inlet and outlet ends, said outlet end opening into said nozzle, power means operatively associated with said duct means for effecting a rapid flow of air therethrough, and loose material feed means for feeding loose material to be classified into said duct means for entrainment of said loose material in the air flowing through said duct means, said nozzle including a partial circular Coanda-surface curving downwardly from said direction.

* * * * *